US006332238B1

(12) United States Patent
Hara et al.

(10) Patent No.: US 6,332,238 B1
(45) **Date of Patent: *Dec. 25, 2001**

(54) CYLINDER CLEANING DEVICE

(75) Inventors: Akira Hara, Tokyo; Hiraku Onuma, Yokohama; Hideo Oyaizu, Tokyo; Yuuichi Suzuki, Shiki, all of (JP); C. Robert Gasparrini, Portchester, NY (US)

(73) Assignee: Baldwin-Japan Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/490,831

(22) Filed: Jan. 25, 2000

Related U.S. Application Data

(62) Division of application No. 08/777,373, filed on Dec. 23, 1996, now Pat. No. 6,038,731.

(30) Foreign Application Priority Data

Dec. 29, 1995 (JP) ..... 7-352877

(51) Int. Cl.[7] ..... B41F 35/00; B41L 41/00

(52) U.S. Cl. ..... 15/256.51; 101/425

(58) Field of Search ..... 15/256.5, 256.51; 101/425; 399/352, 327

(56) References Cited

U.S. PATENT DOCUMENTS

| | | | | |
|---|---|---|---|---|
| 3,792,925 | * | 2/1974 | Mulligan et al. | 399/352 |
| 5,069,128 | * | 12/1991 | Hara et al. | 15/256.51 |
| 5,282,420 | * | 2/1994 | Hara et al. | 15/256.51 |
| 5,404,819 | * | 4/1995 | Hishinuma et al. | 15/256.51 |
| 5,735,212 | * | 4/1998 | Oyaizu | 101/425 |
| 5,749,038 | * | 5/1998 | Fromm et al. | 15/256.51 |
| 5,797,325 | * | 8/1998 | Ebina et al. | 101/425 |

FOREIGN PATENT DOCUMENTS

| | | | |
|---|---|---|---|
| 0479403 | * | 4/1992 | (EP) . |
| 0590195 | * | 4/1994 | (EP) . |
| 04234659 | * | 8/1992 | (JP) . |

* cited by examiner

*Primary Examiner*—Randall E. Chin
(74) *Attorney, Agent, or Firm*—Morgan & Finnegan, LLP

(57) ABSTRACT

A cylinder cleaning device for use with a cleaning fabric supply element having an outer surface comprises a frame and a receiving and supporting member connected to the frame for supporting the outer surface of the cleaning fabric supply element.

12 Claims, 15 Drawing Sheets

(1)

(2)

CYLINDER CLEANING DEVICE

This is a divisional of application Ser. No. 08/777,373 filed Dec. 23, 1996, now U.S. Pat. No. 6,038,731.

BACKGROUND OF THE INVENTION

1. Field of the Invention

The present invention relates to a cylinder cleaning device for cleaning a surface of a cylinder, such as a blanket cylinder of an offset printing machine, an impression cylinder, plate cylinder, or an ink roller. More particularly, the invention relates to a cylinder cleaning device in which the support and fabric insertion members form an assembly with an installed cleaning fabric made in a roll form, or folded in a pleated form (folded in zigzags), or a container holding the cleaning fabric supply element is located thereon.

2. Description of Related Art

Conventionally, in a cylinder cleaning device for cleaning the surface of a cylinder, such as a blanket cylinder of an offset printing machine, using a cleaning fabric, the cleaning fabric is wrapped around a hollow core to form a cleaning fabric roll, into which a rigid shaft, usually made of metal, is inserted. This metal shaft in the cleaning unit functions as a rotation shaft. Such an arrangement has been widely used. As an improvement, a method of directly holding a core to make it a rotation shaft without using such a metal shaft has been proposed in, for example, Japanese Patent Application Laid-open No. Hei 4-234659 Official Gazette.

However, when no metal shaft is used, the rigidness of the cleaning fabric roll is reduced, and the center of the roll deflects by forces applied to the cleaning fabric advancement means so that the cleaning cloth is not uniformly supplied. Thus, there is a danger that a roll will disengage the frame to which it is mounted and fall into the printing machine.

Since the outer diameter of the metal shaft and the dimension of the device used for directly mounting a core to the cleaning device differ in accordance with the kind of cleaning device, not every cleaning fabric roll can be used in every kind of cleaning device. Furthermore, attaching a cleaning fabric roll to the cleaning device, which involves inserting a heavy shaft of strong rigidity into the core, affixing the shaft and core together, and attaching them to the cleaning unit, is cumbersome.

Additionally, using a core rather than a metal shaft has the disadvantage of reducing the amount of space for winding the cleaning fabric thereon since the core wall thickness will increase. In an attempt to increase efficiency, the diameter of the core was reduced. The reduced diameter, however, resulted in a weakened core that could not be attached to the cleaning device with a conventional metal shaft.

It is therefore an object of the present invention to provide a cylinder cleaning device in which the space efficiency for the cleaning fabric supply element is improved by making the roll core part extremely thin, or without using a roll core.

It is another object of the present invention to provide a cylinder cleaning device having a cleaning fabric attaching means which can attach cleaning fabric rolls of different kinds. It is yet another object of the present invention to provide a cylinder cleaning device having an attaching means which can attach cleaning fabric with roll cores of different diameters. It is yet another object of the present invention to provide a cylinder cleaning device having an attaching means which can attach cleaning fabric can easily to a cleaning device with less labor required. It is yet another object of the present invention to provide a cylinder cleaning device having an attaching means which can attach cleaning fabric and can be applied not only for the cleaning fabric in a roll form but also for the cleaning cloth folded in a pleated form, and in container holding form.

SUMMARY OF THE INVENTION

In order to attain the above-described objective, the invention is a cylinder cleaning device which presses the cleaning fabric supplied from the cleaning fabric supply element against a cylinder outer circumference and cleans the cylinder outer circumference surface. A cleaning fabric supply element supporting and receiving means holds and supports the outer circumference of the cleaning fabric supply element, wherein the cleaning fabric supply element may have different forms. Preferably, a means for receiving and supporting is connected to a frame of a cylinder cleaning device, but it can be connected to a frame of the printing press. For example, cleaning fabric supply elements be single rolls with cores of different diameters, or in a pleated form without a roll core, or in container holding form.

Certain other preferred embodiments include:

(1) A cylinder cleaning device in which the cleaning fabric supply element is received in a container and a cylinder outer circumference surface is cleaned by pressing the cleaning fabric supplied from the cleaning fabric supply element in the container against the cylinder outer circumference, and is arranged so that a means for receiving and supporting the container holds the container thereon.

In this arrangement, in which the cleaning fabric supply element is packaged in a rigid container, such as a cassette or cartridge or a container made of film or other packaging material, and then supported by the receiving and supporting means, convenience in handling the cleaning fabric supply element is improved. Especially in the case of the cleaning fabric which is impregnated with a detergent in a liquid form, jellied form, paste form and the like, a container can prevent a detergent from volatilizing and drying, so that performance reduction of the cleaning fabric can be prevented and handling can be made easier. When a highly volatile detergent is used, it becomes more effective by being container enclosed. When a lot of detergent is used as in the case, for example, of the cleaning fabric, for the cylinder cleaning device of an web offset printing machine, the amount of detergent with which the cleaning fabric is impregnated or which is applied to the cleaning fabric is a container can prevent the detergent oozing from the cleaning fabric.

(2) A means for receiving and supporting a cleaning fabric supply element or a container holding a cleaning fabric supply body is provided with a receiving and supporting member which holds the outer circumference of the cleaning fabric supply element or the container with one end supported by a shaft so as to be rotatable and a mechanism for rotating the receiving and supporting member.

When the cleaning fabric supply element itself or the container is attached on or removed from the receiving and supporting member, the receiving and supporting member is rotated and the opening part for handling is widened so that the operation can be simplified. In the case of a method of rolling the cleaning fabric supplied from the cleaning fabric supply element to a cleaning fabric take up reel, the receiving and supporting member does not contact the cleaning fabric take up reel even when the diameter of the cleaning fabric take up reel increases from the cleaning fabric being wrapped around it, because the receiving and supporting member is moved in the direction away from the cleaning fabric take up reel. In other words, the receiving and supporting member moves as the diameter of the cleaning fabric supply element becomes smaller, so that the receiving and supporting member does not interfere with the cleaning fabric take up reel. Accordingly, the device can be made compact by positioning the cleaning fabric receiving and supporting means close to the cleaning fabric take up reel.

(3) A roll which contacts the cleaning fabric and is rotatable in the fabric sending direction, and reverse direction, or only in the fabric sending direction is positioned between the cleaning fabric supply element and a cleaning device pressing part that contacts the cleaning fabric with a cylinder to be cleaned in any of the previous embodiments.

In this arrangement, the cleaning fabric is smoothly supplied to the cleaning device pressing part by the rotation of the roll. Especially in the case of the cleaning impregnated with a detergent, if there is a portion which is compressed before the cylinder pressing part. For example, the portion contacting a supporting bar such as a crossbeam member, the detergent is squeezed from the cleaning fabric when the fabric moves over that portion. By placing the roll between them, compression can be eliminated so that no detergent will be squeezed from the fabric.

(4) The roll rotatable in both fabric sending and reverse direction is provided between the cleaning fabric supply element and the cylinder pressing part of the cleaning device and a cleaning fabric reversing means having a mechanism for reversely rotating the roll is provided so that a part of the cleaning fabric supplied from the cleaning fabric supply element returns to the cleaning fabric supplying side.

In this arrangement, the used part of the cleaning fabric is returned to the cleaning fabric supplying side by driving the roll in reverse. Thus, the cleaning fabric can be used as a cleaning fabric again, so that the efficiency of the cleaning fabric is improved, and the cleaning cost reduced. When the cleaning fabric is supplied, the same operational effect as in embodiment (3) can be expected by rotating the roll in the regular direction.

(5) A brake means applying the brake on the cleaning fabric is positioned between the cleaning fabric supply element and the cylinder pressing part of the previous embodiments.

In this arrangement, when the cleaning fabric is pressed against the cylinder surface, a resulting force works on the cleaning fabric in the direction in which the cylinder rotates. Consequently, there is a fear that the cleaning fabric will be further drawn out of the cleaning fabric supply body by this force, so that the brake is applied on the cleaning fabric in order to overcome the resulting force.

(6) A cleaning fabric tensioning means for tensioning the cleaning fabric is positioned between the cleaning fabric supply element and the cylinder pressing part of the previous embodiments.

In this arrangement, if there is looseness in the cleaning fabric, the fabric will have wrinkles at the cylinder pressing part and the cleaning fabric will be difficult to evenly press when contacting the cylinder surface to be cleaned, so that the cylinder is unevenly cleaned. If there is looseness, there is a possibility that the loose fabric will contact the press cylinder making the cylinder dirty when not cleaning the cylinder. Further, there is a possibility that the cleaning fabric will be caught around the cylinder. The above-described inconveniences don't easily occur when tensioning the cleaning fabric.

(7) A cleaning fabric roll with a roll core is used for the cleaning fabric supply element, and a roll core disengagement prevention means for forming a cleaning fabric feeding through portion smaller than the diameter of the roll core of the cleaning fabric roll between the cleaning fabric supply element and the cylinder pressing part of the cleaning fabric in any of the previous embodiments.

In this arrangement, when the diameter of the cleaning fabric roll becomes smaller by using the cleaning fabric, the roll core may disengage with the cleaning fabric roll supporting receiver means and may damage the cylinder surface. In a case like this, the roll core is caught by the roll core disengagement prevention means while the roll core and the cleaning fabric are separated. Accordingly, only the cleaning fabric is drawn out, and the roll core stays constrained.

(8) In the cylinder cleaning device which presses the cleaning fabric supplied from the cleaning fabric supply element and cleans the cylinder outer circumference surface, the means for receiving and supporting the cleaning fabric supply element holds the outer circumference of the cleaning fabric supply element directly on the crossbeam member placed on both side frames.

In this arrangement, the crossbeam member, which is an assembly member of the cleaning fabric unit, is used as a receiving and supporting member of the cleaning fabric supply element itself or the container receiving the cleaning fabric supply element, so that the device becomes compact and the number of the parts can be reduced.

(9) A control member which is movable and positioned so as to face the cleaning fabric supply element attached to holding part on the crossbeam member, is provided.

In this arrangement, when the cleaning fabric is supplied, a tensile force caused by the cleaning fabric works on the cleaning fabric supply element or the container so that there is a possibility that the cleaning fabric supply element or the container will be unsteady. When held unsteadily like this, there is a possibility that the cleaning fabric will not be smoothly supplied. By holding the cleaning fabric supply element itself or the container, between the receiving and supporting member and the control member, to hold it more stably, the cleaning fabric can be smoothly supplied.

(10) The brake is applied on the cleaning fabric supply element by the control member pressing down on the cleaning fabric supply element in the previous embodiment.

In this arrangement, by making the control member have a brake action, the brake can be applied with a large portion of the cleaning fabric supply element contacting the control member in a longitudinal direction. Thus, the number of the parts can be reduced; and the device can be made compact. The dimensional area in which the control member contacts the outer circumference surface of the cleaning fabric supply element can be made large, and any part of the cleaning fabric supply element is not deformed down, so that the brake is uniformly applied. Especially, in the case of the cleaning fabric impregnated with the liquid, liquid squeezed out as a result of partly pressing the fabric can be prevented.

(11) In the cylinder cleaning device which presses the cleaning fabric supplied from the cleaning fabric supply element against the cylinder outer circumference and cleans the cylinder outer circumference surface, the means for supporting and receiving the cleaning fabric supply element consists of a first member holding the outer circumference of the cleaning fabric supply element or the container holding the cleaning fabric supply element, and a second member positioned so as to face the first member, with the first member and/or the second member provided so as to be movable, and the cleaning fabric supply element itself or the container holding the cleaning fabric supply element are held between both members.

In this arrangement, the cleaning fabric supply element itself or the container is steadily and surely held between two members working together. Especially, when the cleaning fabric supply element itself is held between two members, the holding function works following the change of the shape of the cleaning fabric supply element which becomes smaller by supplying the cleaning fabric from the cleaning fabric supply element, so that the cleaning fabric is steadily and surely supported and received.

(12) The brake is applied on the cleaning fabric by the first member and the second member which work together.

In this arrangement, the operational effects achieved with regard to embodiments 10 and 11 can be obtained at the same time.

(13) The cylinder cleaning device which presses the cleaning fabric supplied from the cleaning fabric supply element, with the cleaning fabric made in a roll form, against the cylinder outer circumference and cleans the cylinder outer circumference surface is provided with a means for supporting and receiving the cleaning fabric supply body with a movable member, a means for moving the member supporting and receiving the cleaning fabric supply element, and a cleaning fabric reversing means for returning the cleaning fabric supplied from the cleaning fabric supply element to the cleaning fabric supplying side. By rotating the roll in the forward and reverse direction by a driving mechanism, part of the cleaning fabric supplied is returned to the cleaning fabric supplying side to be reused by driving the roll in reverse. Additionally, the brake is applied on the cleaning fabric by moving the member supporting and receiving the cleaning fabric supply element and by contacting the cleaning fabric supply element with the roll of the cleaning fabric reversing means.

In this arrangement, one roll has the function of returning the used part of the cleaning fabric to be reused and the function of applying the brake on the cleaning fabric, so that the device can be made compact.

(14) The cylinder cleaning device which presses the cleaning fabric supplied from the cleaning fabric supply element, with the cleaning fabric made in a roll form, against the cylinder outer circumference to clean the cylinder outer circumference surface is provided with a means for supporting and receiving the cleaning fabric supply element with the movable member and a means for moving the member supporting and receiving the cleaning fabric supply element in the direction of the crossbeam placed on both side frames. The brake is applied by moving the member supporting and receiving the cleaning fabric supply element and by pressing the cleaning fabric supply element against the crossbeam member.

In this arrangement, the operational effects achieved with regard to embodiments 2 and 5 can be obtained at the same time.

DETAILED DESCRIPTION OF THE PREFERRED EMBODIMENTS

A characteristic of the present invention is that the cleaning fabric supply element can have any number of forms, such as a rolled form, or in a folded pleated form (i.e. folded in zigzags). Cleaning fabric rolls with either a round-formed roll core, an oval formed roll core, a polygonal-formed roll core, or without a roll core can also be used.

The cleaning fabric can be made of ordinary fabric, a nonwoven fabric, paper, or plastic film with or without processing, or other suitable materials. Processed cleaning fabrics include, for example, fabric previously impregnated with a solvent or detergent, fabric previously impregnated which is packaged in a vacuum pack, and fabric to which a detergent in a jellied or a paste form has been applied.

Figure 1:
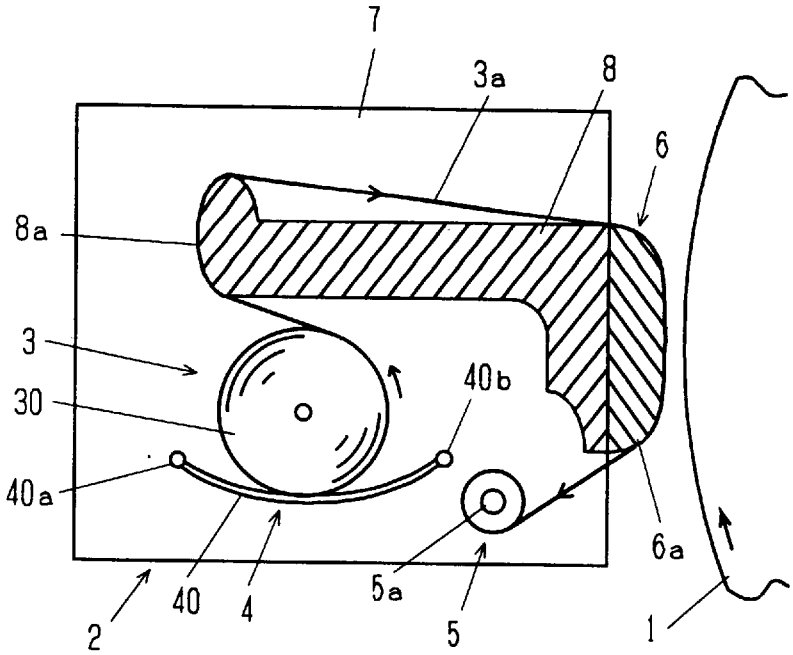
FIG. 1 is a sectional view of the basic arrangement of the cylinder cleaning device of the present invention.

Preferred embodiments of the present invention will now be described with reference to the drawings. Turning to FIG. 1, there is illustrated a sectional view of the basic arrangement of a cylinder cleaning device of the present invention. The cylinder cleaning device is arranged as a cleaning unit 2 which is located so as to face a cylinder 1 of a press. The cleaning unit 2 includes a cleaning fabric supporting receiver 4 for receiving a cleaning fabric supply element 3, a cleaning fabric advancing means 5 which draws out a cleaning fabric 3*a* from the cleaning fabric supply element 3, and a cylinder pressing part 6, which presses the cleaning fabric 3*a* against the surface of the cylinder 1. The cleaning fabric 3*a* is stretched between the cleaning fabric supporting receiver 4 and the cleaning fabric advancing part 5. It is preferred that a brake mechanism, described below, be applied to the cleaning fabric 3*a*. This brake mechanism is positioned on the upper portion of the cylinder pressing part 6. A pressure pad 6*a* portion of the cylinder pressing part 6 is supported by a supporting bar 8 which is a crossbeam member laid across a side frame 7 positioned on both sides of the cleaning unit 2.

Concrete examples of each of the above-described parts will now be described. The cleaning fabric supporting receiver 4 has a fixed type of receiver in which both end portions 40*a* and 40*b* of the cleaning fabric supporting member 40 are fixedly attached to the side frame 7. FIG. 1 illustrates a typical example of a fixed type of the cleaning fabric supporting receiver 4. A cleaning fabric roll 30 is located on the cleaning fabric supporting receiver 4. The cleaning fabric roll supporting member 40 used with the cleaning fabric supporting receiver 4 has a surface on which the cleaning fabric roll 30 is placed. In this example, the sectional surface is formed to be a curved surface in virtually an arc form.

Figure 2:
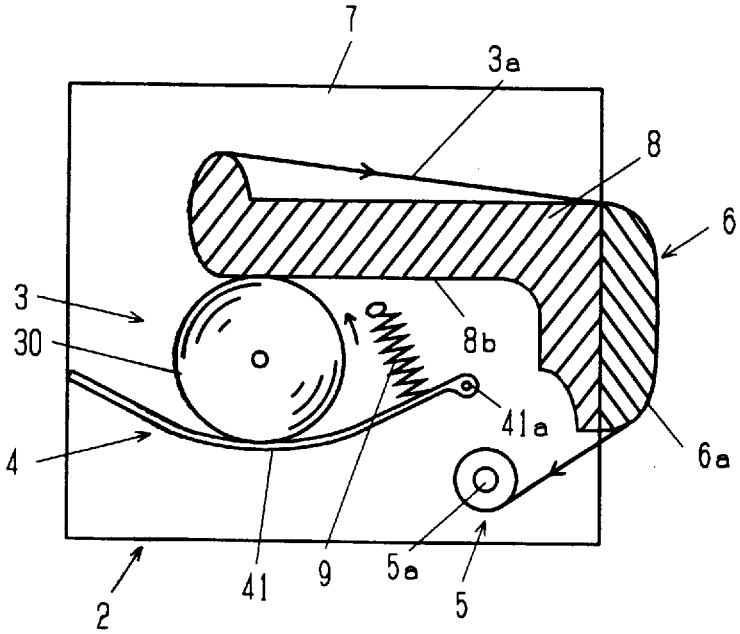
FIG. 2 is a sectional view of a typical example of a mobile type of cleaning fabric supporting receiver.

FIG. 2 illustrates one typical example of a moveable type of a cleaning fabric supporting receiver 4. Only one end 41*a* of the cleaning fabric roll supporting member 41 is fixedly attached to the frame 7 while the opposite end to the shaft supported part is rotatable in the direction of the supporting bar 8. Between the side frame 7 and the cleaning fabric roll supporting member 41 there is provided a spring 9 which urges the cleaning fabric roll supporting member 41 to rotate in the direction of the supporting bar 8.

Figure 3:
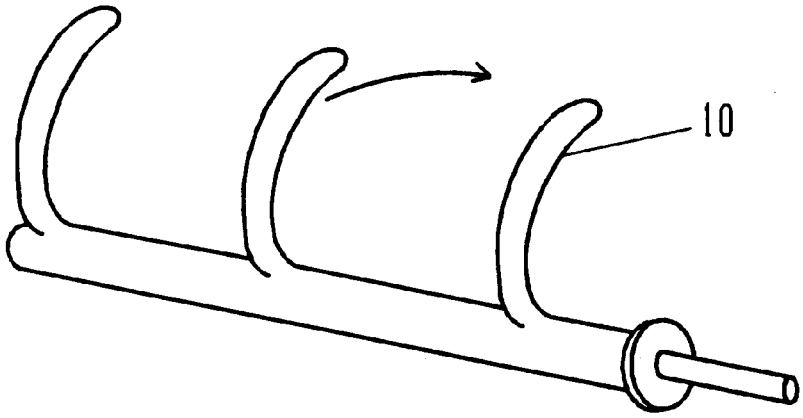
FIG. 3 is a perspective view of the cleaning fabric supporting receiver arranged in a fork form.
Figure 4:
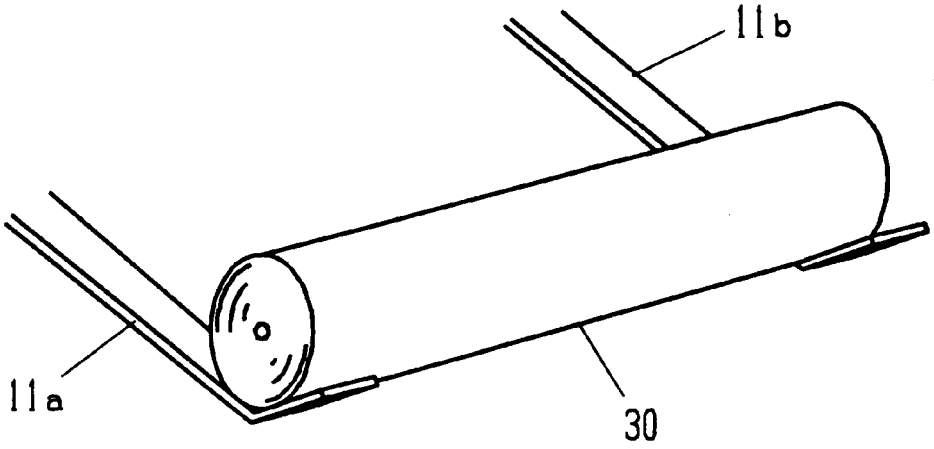
FIG. 4 is a perspective view of the cleaning fabric supporting receiver arranged to support and receive both ends of the cleaning fabric roll.
Figure 5:
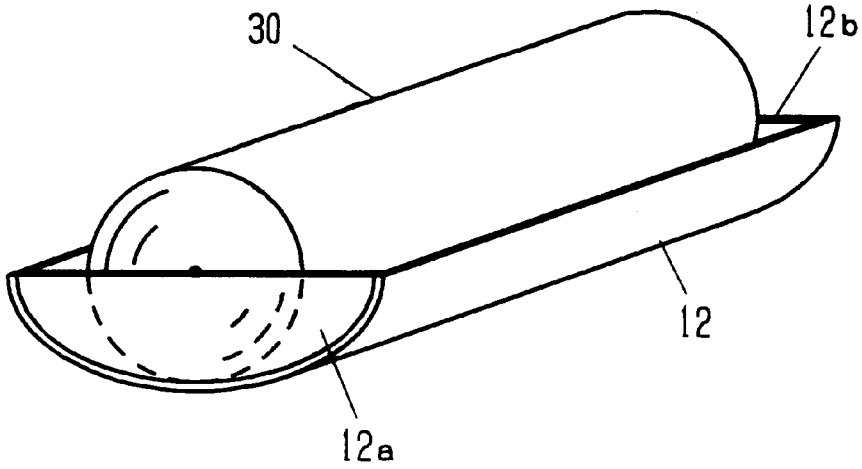
FIG. 5 is a perspective view of the cleaning fabric supporting receiver arranged in a tub form to support and receive the fabric with the member in a tub form.
Figure 6:
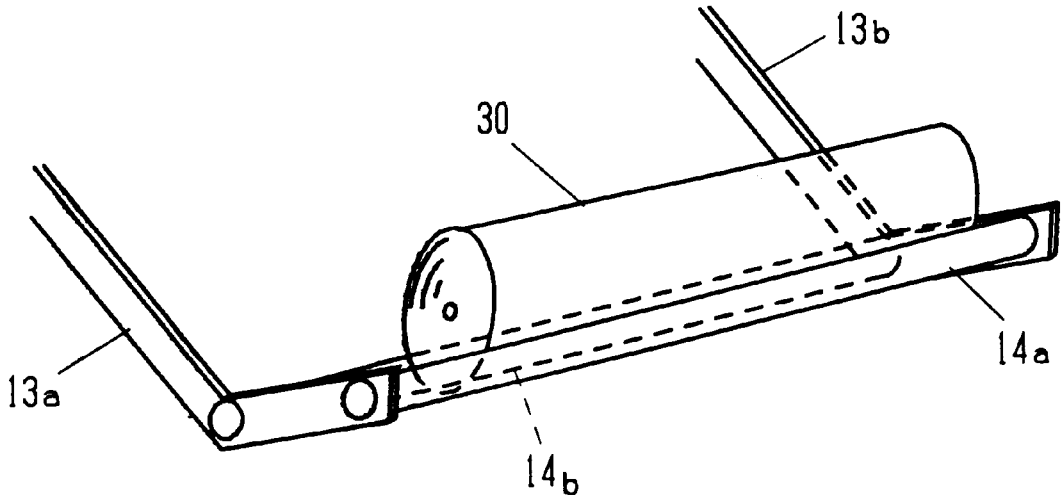
FIG. 6 is a perspective view of the cleaning fabric supporting receiver arranged to support and receive the fabric with lateral bars.
Figure 7:
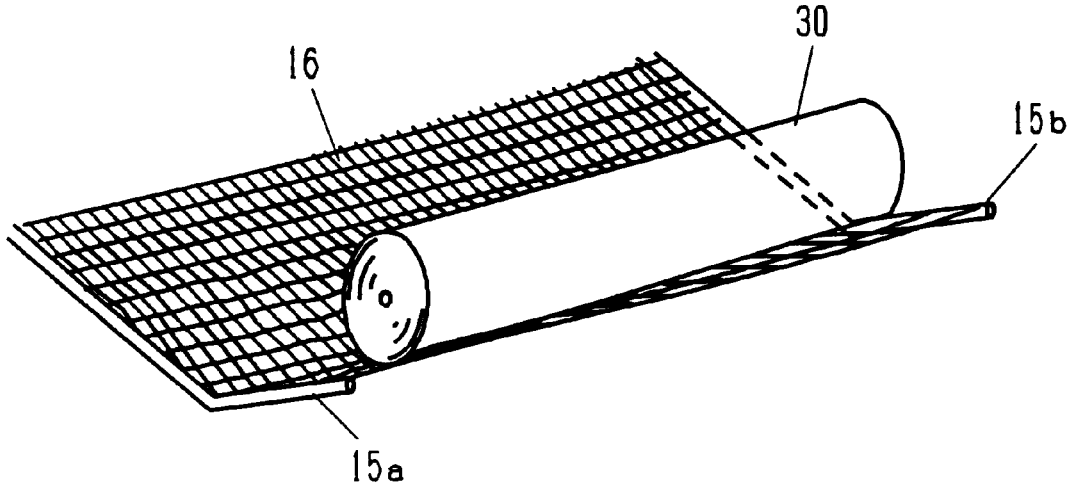
FIG. 7 is a perspective view of the cleaning fabric supporting receiver arranged to support and receive the fabric with the member in a net form.
Figure 8:
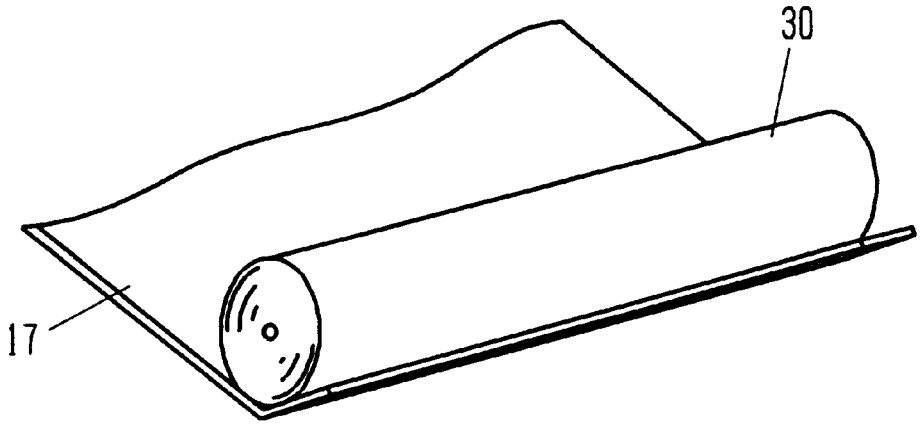
FIG. 8 is a perspective view of the cleaning fabric supporting receiver which supports and receives the fabric with the plate member.
Figure 9:
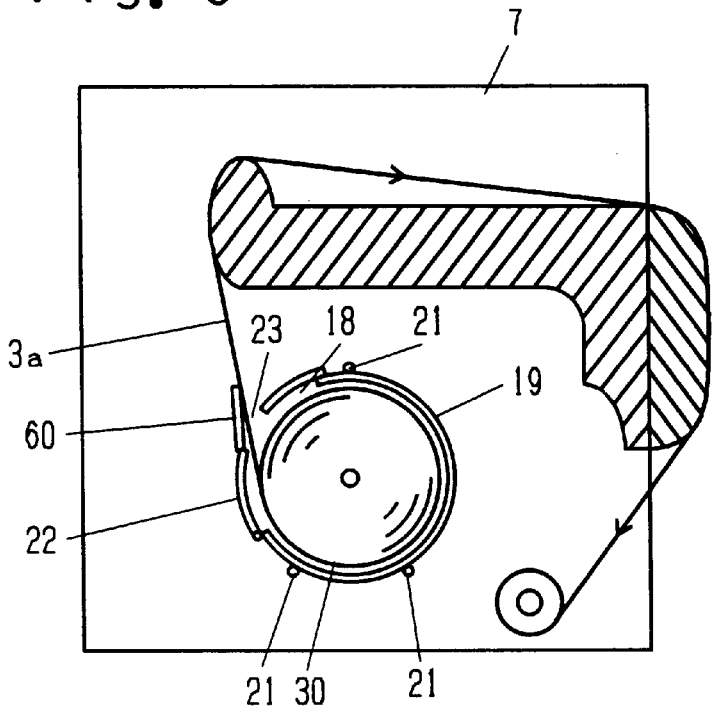
FIG. 9 is a sectional view of the cleaning fabric supporting receiver arranged to support and receive the cassette contained with the cleaning fabric roll therein.
Figure 11:
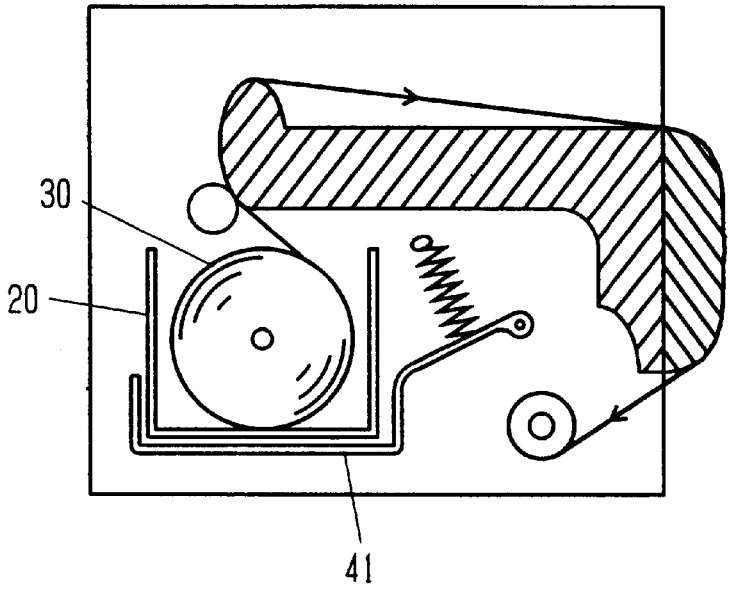
FIG. 11 is a sectional view of the cleaning fabric supporting receiver arranged to support and receive an open type contained with the cleaning fabric roll therein.

There are a number of arrangements of the cleaning fabric supporting receiver for use with cleaning fabric rolls. As shown in FIG. 3, a fork-shaped structure, having multiple curved tines 10*a* is an alternative embodiment. Another embodiment, as shown in FIG. 4, is an arrangement in which two plate pieces having formed members 11*a* and 11*b* are provided at predetermined intervals for supporting both ends of the cleaning fabric roll 30. Other embodiments include: an arrangement in a tub form which supports and receives the cleaning fabric roll with a tub formed member 12 containing the entire element of the cleaning fabric roll 30 therein (as shown in FIG. 5), an arrangement in which two lateral bars 14*a* and 14*b* are positioned at supporting parts 13*a* and 13*b* with the cleaning fabric roll 30 located between the lateral bars 14*a* and 14*b* (as shown in FIG. 6), an arrangement in which a net 16 is positioned between two longitudinal bars 15*a* and 15*b* with the cleaning fabric roll 30 located on the net 16 (as shown in FIG. 7), an arrangement in which the foremost end portion of a sheet of plate 17 is folded and the cleaning fabric roll 30 is located on the folded portion of the plate 17 (as shown in FIG. 8), an arrangement in which the cleaning fabric roll 30 is taken in a container 19 and located on the inner wall of the container 19 having a roll attachment entrance 18 provided at one part of its outer circumference (as shown in FIG. 9), and an arrangement in which the cleaning fabric roll 30 is taken in a container 20 without a lid, and this container 20 is located on the cleaning fabric supporting member 41 (as shown in FIG. 11). Any of these arrangement can be selected. Additionally, any material having the strength to support and receive the cleaning fabric supply element 30 is suitable for use as the cleaning fabric supporting member 41, and such suitable material can be selected from a simple substance or a mixture of metal, resin, rubber, fiber, or flexible material such as plastic, or fabric.

When the cleaning fabric 30, is impregnated with a detergent to suitable saturation levels, the cleaning fabric supporting receiver of the tub-shaped arrangement 12 with a wall on both ends, illustrated in FIG. 5, is especially preferable since the device can be used without hindrance even if the detergent is squeezed from the fabric by force. A rigid container such as a cassette, cartridge, or container made of soft material such as film or laminated paper can be used for the container. A state in which the fabric is wrapped with film material is also suitable.

The container 19 illustrated in FIG. 9 is fixed on a side plate 7 by fasteners 21, with a cover 22 provided at the roll attachment opening 18 of the container 19. The cleaning fabric roll 30 is placed in the container by opening this cover 22. The cleaning fabric 3*a* is drawn out of the container through a slit 23 opened by opening the cover 22. In the case of a container with a lid, the cleaning fabric 3*a* is normally supplied with the lid open, but the cleaning fabric 3*a* may be supplied from the slit provided at the lid with the lid closed as FIG. 9 illustrates.

Figure 10:
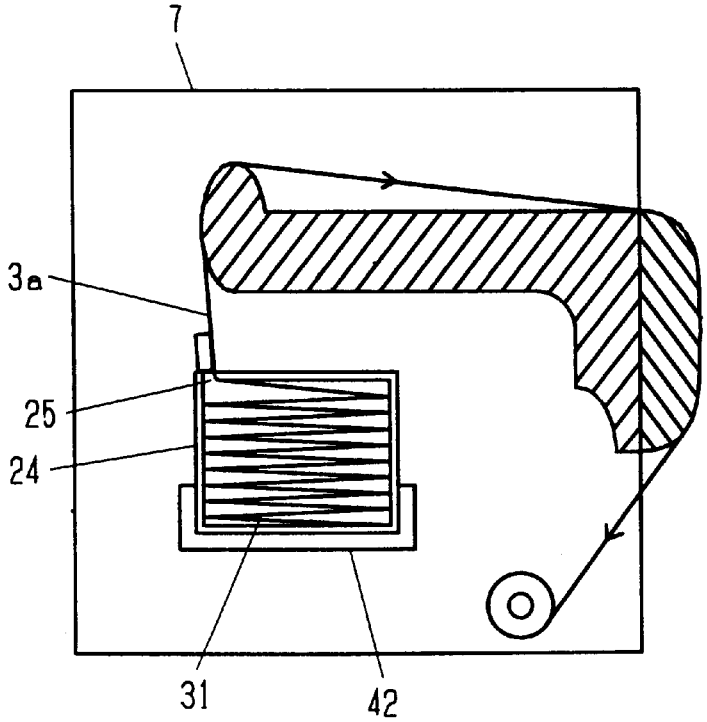
FIG. 10 is a sectional view of the cleaning fabric supporting receiver arranged to support and receive the contained with the cleaning fabric folded in a pleated form supply element therein.

A cleaning fabric supply element 31 for supplying fabric folded in a pleated form contained in a cassette container 24 is illustrated in FIG. 10. The container 24 is supported in a cleaning fabric supporting receiver 42 fixed on the side frame 7. The cleaning fabric 3*a* is drawn out of a slit 25 of the container 24. Modifications of the cleaning fabric supporting member 41 of FIG. 2 are illustrated in FIGS. 12 and 13.

Figure 12:
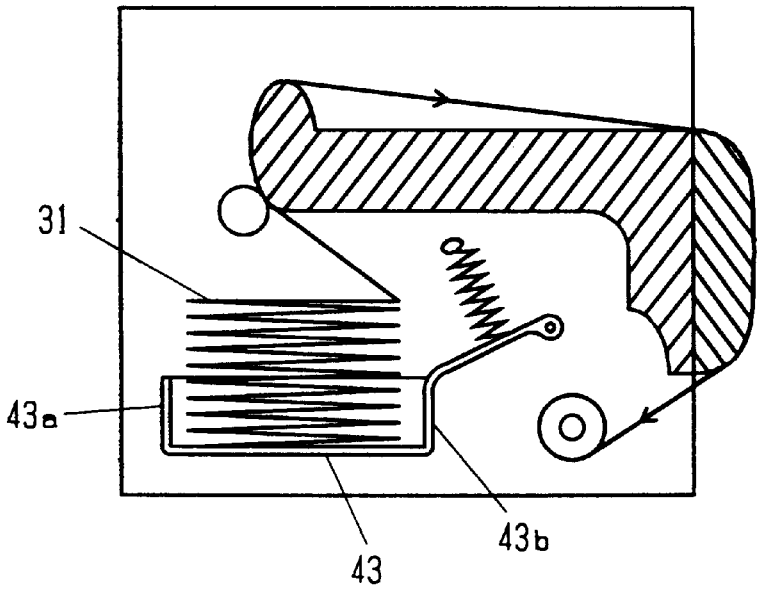
FIG. 12 is a sectional view of he cleaning fabric supporting receiver arranged to receive the cleaning fabric folder in a plated form supply element itself.
Figure 13:
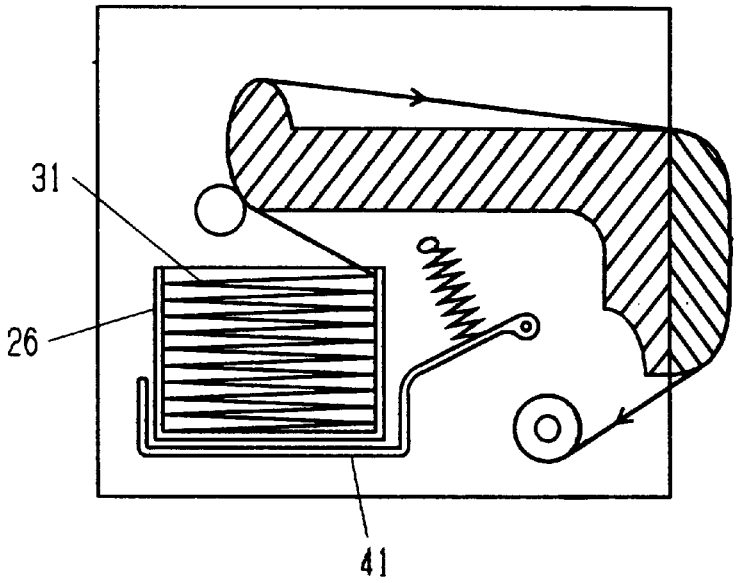
FIG. 13 is a sectional view of the cleaning fabric supporting receiver arranged to support and receive an open type container with the cleaning fabric folded in a pleated form supply element therein.

As illustrated in FIG. 12, a suitable arrangement is selected from an arrangement in which a wall part 43*a* is provided in the longitudinal direction of the cleaning fabric folded in a pleated form supply element 31 so as to face the cleaning fabric supply element 31, and the cleaning fabric folded in a pleated form supply element 31 itself is placed on the cleaning fabric supporting member 43. The width between walls 43*a*, 43*b* is a little larger than the width of the folded cleaning fabric. FIG. 13 illustrates an arrangement in which the cleaning fabric is folded in a pleated form in a container 26 without a lid. The container 26 is located on the cleaning fabric supporting member 41.

Figure 14:
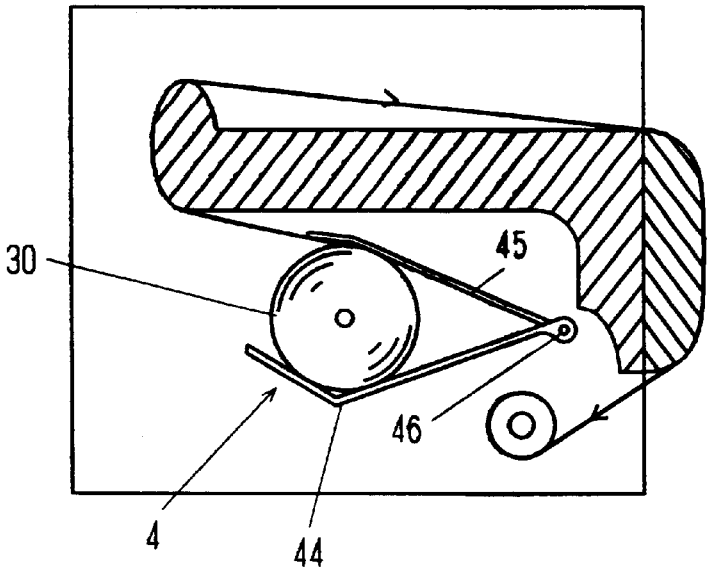
FIG. 14 is a sectional view of the cleaning fabric supporting receiver arranged to support and receive the cleaning fabric roll by holding the cleaning fabric roll between the receiving member and the control member.

The cleaning fabric supporting receiver 4 illustrated in FIG. 14 consists of a receiving member 44 and a set member 45 positioned so as to face the receiving member 44. The receiving member 44 and the control member 45 are provided so as to be pivotable about one end 46. The cleaning fabric roll 30 is located on the receiving member 44 and is held under the control member 45. Though in this example both receiving member 44 and control member 45 are rotatable, either one of the receiving member 44 or 45 may be made rotatable and the cleaning fabric roll may be held on the receiving member 44 by either the receiving member 44 or control member 45 moving in the direction of the other. At least one member is urged towards the other to press the cleaning fabric roll 30 by a force means such as a spring.

Figure 15:
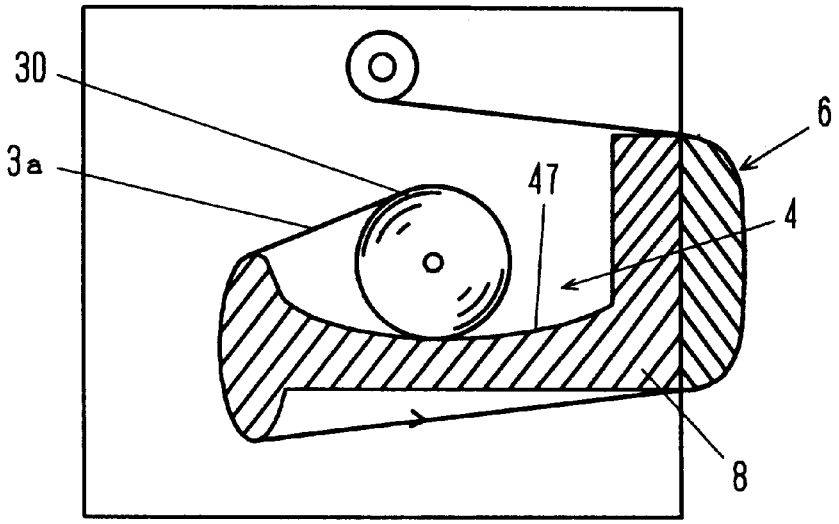
FIG. 15 is a sectional view of the cleaning fabric supporting receiver arranged to locate the cleaning fabric roll on the supporting bar.
Figure 16:
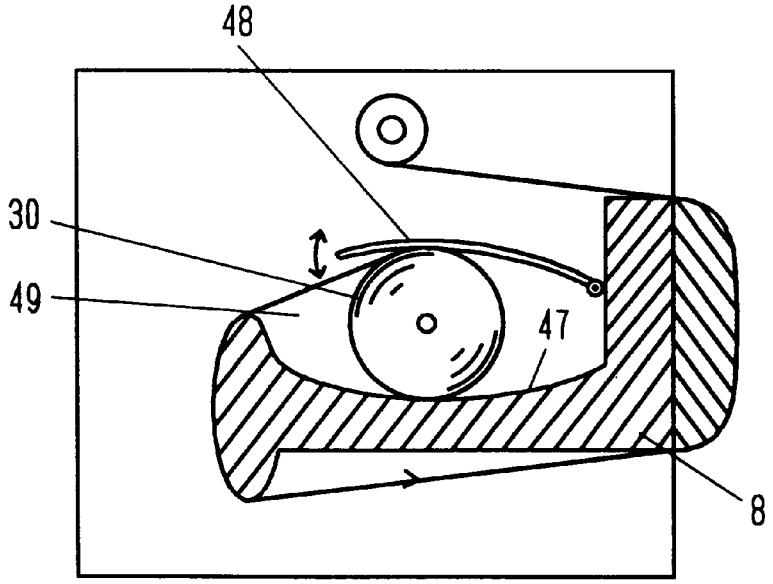
FIG. 16 is a sectional view of the cleaning fabric supporting receiver arranged to hold the cleaning fabric roll on the supporting bar by the control member.

Although the above-described embodiments of the cleaning fabric supporting receiver 4 can be located away from supporting bar 8, the supporting bar 8 itself may be used to support the cleaning fabric roll 30. In the cleaning fabric supporting receiver 4 illustrated in FIG. 15, the cleaning fabric roll 30 is located on a receiving surface 47 of the supporting bar 8. The receiving surface 47 is made to have a concave surface so that the cleaning fabric roll 30 is stably located thereon. In this example, the cleaning fabric 3*a* supplied from the cleaning fabric roll 30 moves around the supporting bar 8 to be supplied to the cylinder pressing part 6. A pivotable control member 48, illustrated in FIG. 16, faces the receiving part 47 of the supporting bars. In this arrangement, when the cleaning fabric roll 30 is located on the supporting bar 8, the control member 48 is lifted up to widen the opening 49 of the cleaning fabric 30, and after the cleaning fabric roll 30 is taken in through the attachment opening 49, the control member 48 is lowered. By urging the control member 48 in the direction of the cleaning fabric roll, for example, by means of a spring (not shown) and by always narrowing the attachment opening 49 of the cleaning fabric roll 30, the cleaning fabric roll 30 can be more stably located on the supporting bar 8.

Figure 17:
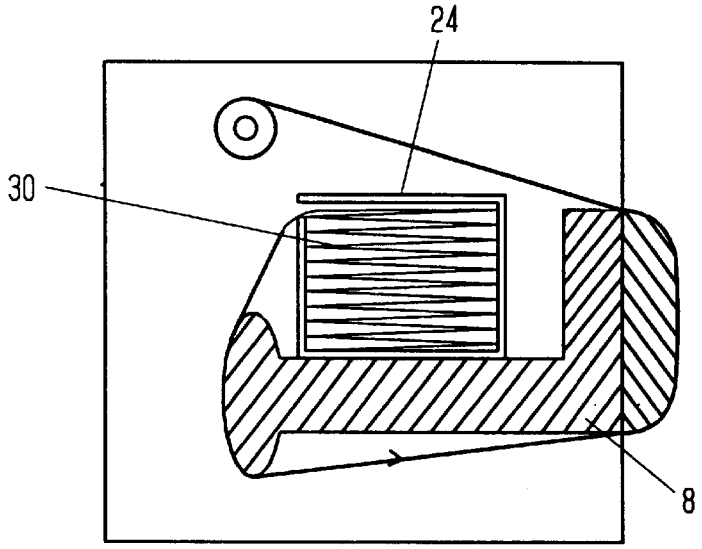
FIG. 17 is a sectional view of the cleaning fabric supporting receiver in which the container 24 receiving the cleaning fabric folded in a pleated form supply body is located on the supporting bar.

Turning now to FIG. 17, there is illustrated an embodiment in which the container 24 for receiving the cleaning fabric folded in a pleated form supply element 30 is located on the supporting bar 8. Though the illustration in the drawing is omitted, the receiving member 44 may be separately positioned as FIG. 14 illustrates instead of the receiving part of the supporting bar, and the control member 45 may be arranged so as to hold the cleaning fabric roll 30 located on this receiving member 44. It may be suitable if at least the receiving member 44 or control member 45 or both is or are arranged so as to be movable toward the other member.

The cleaning fabric advancing part 5 of FIG. 1 and FIG. 2 consists of the cleaning fabric take up 5*a* and the driving device (not illustrated in the drawings) such as a motor which rotates the reel 5*a*. The cleaning fabric 3*a* is supplied from the cleaning fabric roll 30 by winding the used cleaning fabric around the cleaning fabric take up reel 5*a*. Alternatively, as shown in FIG. 12, the reel 5*a* winds fabric 3*a* supplied from a pleated form supply element 31. When the cleaning fabric roll 30 or the cleaning fabric folded in a pleated form supply element 31 is located on the movable type of cleaning fabric supporting member, the cleaning fabric supporting member, the cleaning fabric advancing part 5 can be positioned adjacent the shaft supported side 41*a* of the cleaning fabric supporting member 41, 43 and near the cleaning fabric supporting member 41, 43 so that the cleaning unit 2 can be made compact. That is to say, as the diameter of the cleaning fabric roll 30 becomes smaller and the height of the cleaning fabric folded in a pleated form supply element 31 becomes lower, the weight of the supply is reduced so that the cleaning fabric supporting member 41, 43 is moved towards the supporting bar 8 by the spring 9.

It follows that the diameter of the cleaning fabric advancing part becomes larger when the cleaning fabric 3*a* is wound around the cleaning fabric take up reel 5*a*. Even if the diameter of the cleaning fabric take up reel 5*a* becomes large, the cleaning fabric supporting member 41, 43 moves towards the support bar 8 to widen the clearance formed between the cleaning fabric advancing part and the cleaning fabric supporting member 41, 43 so that the cleaning fabric wound around the reel 5*a* does not contact the bottom surface of the cleaning fabric supporting member 41, 43.

Figure 18:
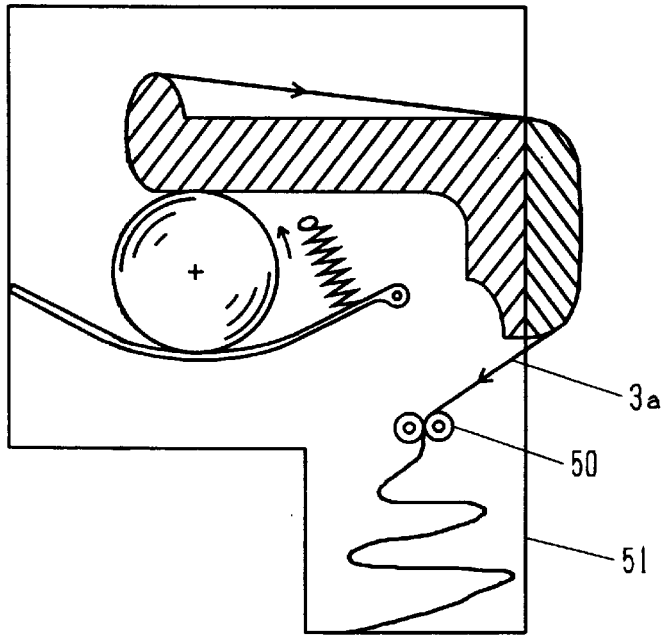
FIG. 18 is a sectional view of the arrangement of another embodiment of the cleaning fabric advancing part.

FIG. 18 illustrates another embodiment of the cleaning fabric advancing part. In this embodiment, one of a pair of pinch rolls 50 is driven to draw the cleaning fabric 3*a* from the cleaning fabric supply held between the pinch rolls 50. The cleaning fabric 3*a* is contained in the receiving part 51 positioned below the pinch rolls 50. When the cleaning fabric 3*a* is drawn by the pinch rolls 50, the cleaning fabric 3*a* is simply stored in the receiving part 51, as FIG. 18 illustrates, or a cutter (not illustrated in the drawing) is positioned below the pinch rolls to cut the used cleaning fabric 3*a*.

The brake mechanism will now be described in greater detail. As shown in FIGS. 1, the brake mechanism is formed on the outer circumference surface of the back end portion 8*a* of the supporting bar 8. The supporting bar 8 is extended in the direction opposite to the pressure pad 6*a* so as to cover the cleaning fabric supporting receiver 4. The cleaning fabric 3*a* is supplied from the cleaning fabric 30 located below the supporting bar 8 apart from the back end portion 8*a* of the supporting bar, contacts the outer circumference surface so as to move round the back end portion 8*a* of the supporting, and moves along the back surface of the pressure pad 6*a* by way of this supporting bar 8 to be rolled round the cleaning fabric take up reel 5*a*. When the cleaning fabric 3*a* supplied from the cleaning fabric roll 30 moves forward in a state in which it contact the outer circumference surface of the back end portion 8*a* of the supporting bar, a tension acts on the cleaning fabric 3*a* due to the friction between the cleaning fabric 3*a* and the back end portion 8*a* of the outer circumference surface. Thus, looseness or slack in the cleaning fabric 3*a* is prevented.

Another embodiment of the brake mechanism is shown in FIG. 2. The brake mechanism 41, which also comprises the cleaning fabric supporting member 41, presses the outer circumference of the cleaning fabric roll 30 against the back surface 8*b* of the supporting bar 8. The spring 9 continuously urges the cleaning cloth supporting member 41 toward the bottom surface 8*b*. Thus, the cleaning fabric roll 30 is kept in contact with the bottom surface 8*b*.

The brake mechanisms illustrated in FIG. 9 and FIG. 10 apply the brake on the cleaning fabric 3*a* supplied through the slits 23 and 25 in the cover 22 of the containers 19 and 24, near the slits 23 an 25. A brake plate 60 provided at the slits 23 and 25 contacts the cleaning fabric 3*a*.

Figure 19:
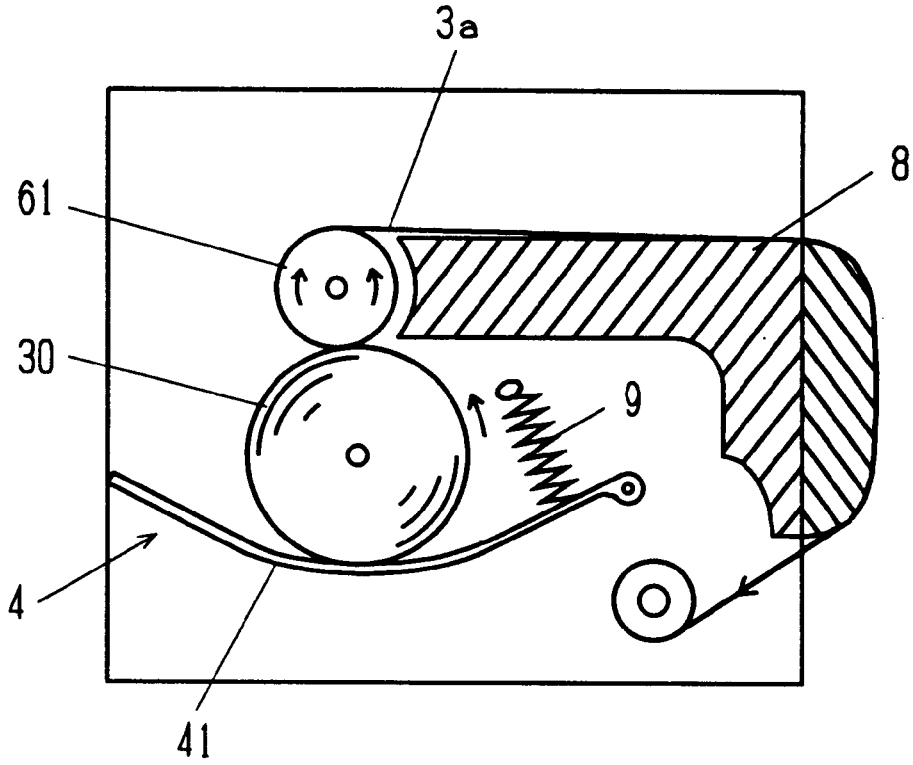
FIG. 19 is a sectional view of the arrangement of the device provided with a touch roll.

The brake mechanism illustrated in FIG. 19 includes a touch roll 61 having the brake mechanism positioned on the cleaning fabric roll 30. As shown, the cleaning fabric roll 30 is located on the cleaning fabric supporting member 41 and spring 9, which urges the cleaning fabric supporting member 41 towards the touch roll 61, presses the outer circumference of the cleaning fabric roll 30 against the outer circumference surface of the touch roll 61. Knurling is provided on the surface of the touch roll 61 so that the cleaning fabric 3*a* doesn't slip. In this case, it is not essential to press the cleaning fabric roll 30 against the touch roll 61.

Figure 20:
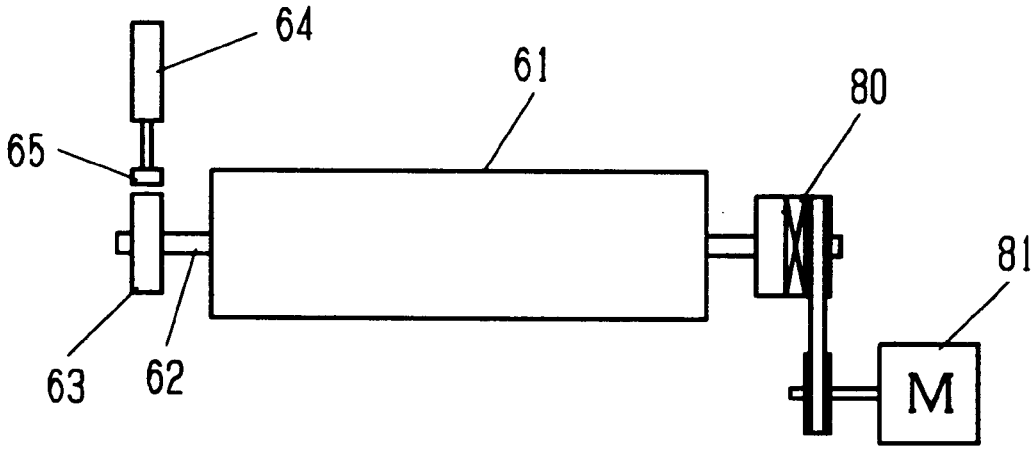
FIG. 20 is a block diagram of an embodiment of the mechanism part of the touch roll.

One example of the brake mechanism of the touch roll 61 is illustrated in FIG. 20. The brake is applied by attaching a brake disc 63 on a shaft 62 of the touch roll 61 and by pressing a brake shoe 65 against the brake disc 63 by a brake pressing means 64.

Figure 21:
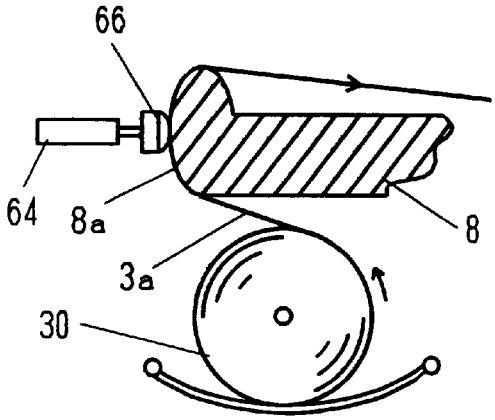
FIG. 21 is a block diagram of an embodiment of the brake mechanism part.

In the brake mechanism part illustrated in FIG. 21, a brake shoe 66 faces the end surface 8*a* of the supporting bar 8 with the cleaning fabric 3*a* interposed between the brake shoe 66 and the end surface 8*a*. The brake is applied by the brake pressing means 64 moving the brake shoe 66 to press the cleaning fabric 3*a* against the end surface 8*a* of the supporting bar.

Figure 22:
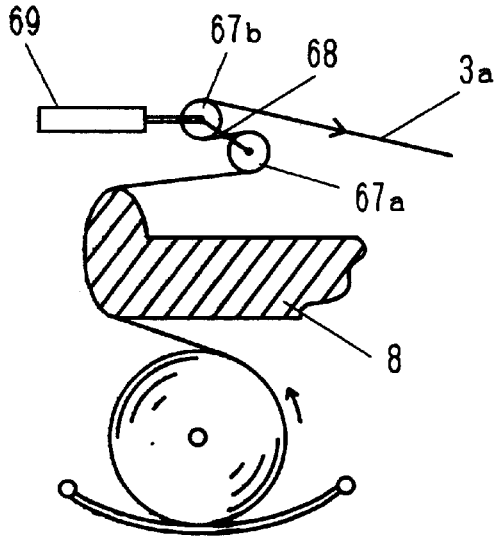
FIG. 22(1) and FIG. 22(2) are block diagrams of the brake/tensioning mechanism using a S-wrap bar.
Figure 22:
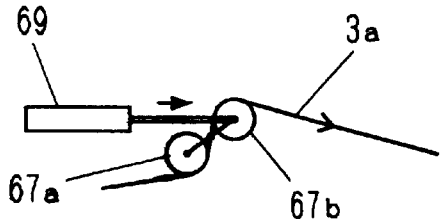

In the brake mechanism illustrated in FIG. 22(1) and FIG. 22(2), two bars with a round shaped sectional surface 67*a* and 67*b* are positioned in parallel to a connection element 68 so that they do not rotate, and the connection element 68 is supported so as to be rotatable. This connection element 68 is rotated a predetermined angle to the direction in which the cleaning fabric 3*a* advances by a S-wrap driving means 69. The cleaning fabric 3*a* moves through bars 67*a* and 67*b* in an S-shaped path, and the brake is applied or released by changing the area in which the cleaning fabric 3*a* contacts the bars 67*a*, 67*b* by rotating the connection element 68. In other words, when two bars are parallel to the direction in which the cleaning fabric 3*a* advances, that is, in the state illustrated in FIG. 22(2) the dimensional area in which the cleaning fabric 3*a* contacts the bars 67*a*, 67*b* becomes small, and the brake is not applied. On the other hand, when the two bars 67*a*, 67*b* are rotated in the direction which vertically crosses the direction in which the cleaning fabric advances, as illustrated in FIG. 22(1), the dimensional area in which the cleaning fabric 3*a* contacts the bars 67*a*, 67*b* becomes large and the brake is applied.

Figure 23:
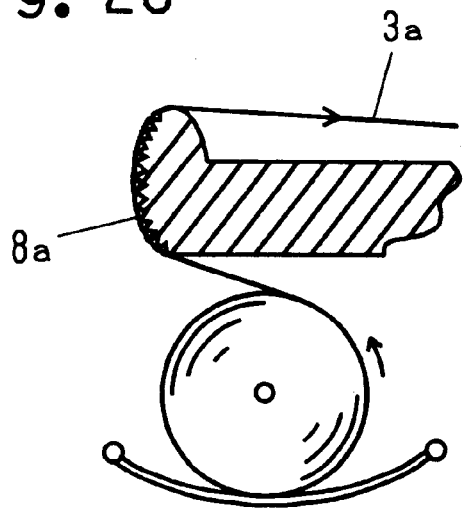
FIG. 23 is a block diagram of the support bar which has brake/tensioning action in itself.

The brake mechanism illustrated in FIG. 23 comprises a coarse end surface 8*a*. The brake is applied by making the cleaning fabric 3*a* contact the end surface 8*a*.

Figure 24:
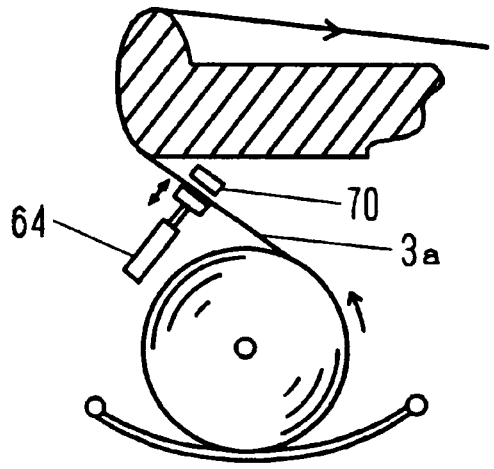
FIG. 24 is a block diagram of another embodiment of the brake mechanism.

The brake mechanism illustrated in FIG. 24, comprises two brake plates 70 that are positioned so as to hold the cleaning fabric 3*a* between them. Moving the brake plate 70 by the pressing means 64, at least one of the brake plates 70 is brought into contact with the cleaning fabric 3*a*. thus, the resulting friction brakes the fabric 3*a*.

Further, in FIG. 14, either receiving member 44 or the control member 45 or both is or are urged to move in the direction in which they hold the cleaning fabric 3*a* between them. The brake can be applied on the cleaning fabric 3*a* by holding the cleaning fabric 3*a* between both members 44, 45. The arrangement in FIG. 16 in which the control member 48 is given momentum in the direction toward the supporting bar 8 also provides the brake action.

A cleaning fabric tensioning means is also employed in a preferred embodiment. The cleaning fabric tensioning means is employed to prevent slack in the cleaning fabric 3*a* when it is disengaged from the cylinder to be cleaned. Due to the action of the above-described brake mechanisms, when the brake is applied on the cleaning fabric, the action places tensioning the cleaning fabric at the same time. For example, in the arrangement in which the cleaning fabric 3*a* of FIG. 1 makes contact with the end surface 8*a* of the support bar 8, when the brake is applied by the friction between the cleaning fabric 3*a* and the support bar 8, the cleaning fabric 3*a* is tensioned by the friction force at the same time. The brake mechanisms of FIG. 21 and FIG. 24 also place tension on the cleaning fabric 3*a*. In the brake mechanism illustrated in FIG. 22(1) and FIG. 22(2), friction force always works between the S-wrap bar and the cleaning fabric so that the cleaning fabric is tensioned. That is to say, two bars 67*a*, 67*b* of the S-wrap bar tensioned the cleaning fabric 3*a* by rotating around the portion between them. The cleaning fabric 3*a* is always given tension force by using a torsion spring and/or flexible spring, and adjustable load.

Figure 25:
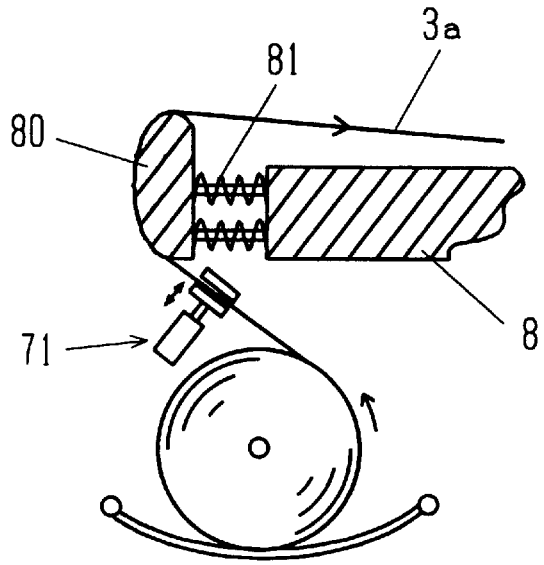
FIG. 25 is a block diagram of an embodiment in which the brake mechanism and the tensioning mechanism are combined.

In the cleaning fabric tensioning mechanism illustrated in FIG. 25, the end potion of the supporting bar 8 consists of a holding part 80, which is urged to move in the direction opposite to the cylinder pressing part by a spring 81. Accordingly, when the pressure pad stops pressing the cleaning fabric against the cylinder surface by letting the compressed air out of the pressure pad, looseness and slack in the cleaning fabric 3*a* is absorbed by the movement of the holding part 80. Thus, the cleaning fabric 3*a* is always kept tensioned and taught. Preferably, a brake mechanism 71 is positioned between the cleaning fabric supply element 30 and the holding part 80 so that a greater effect of preventing the cleaning fabric 3*a* from loosening can be obtained by applying the brake 71 on the cleaning fabric 3*a*.

Figure 26:
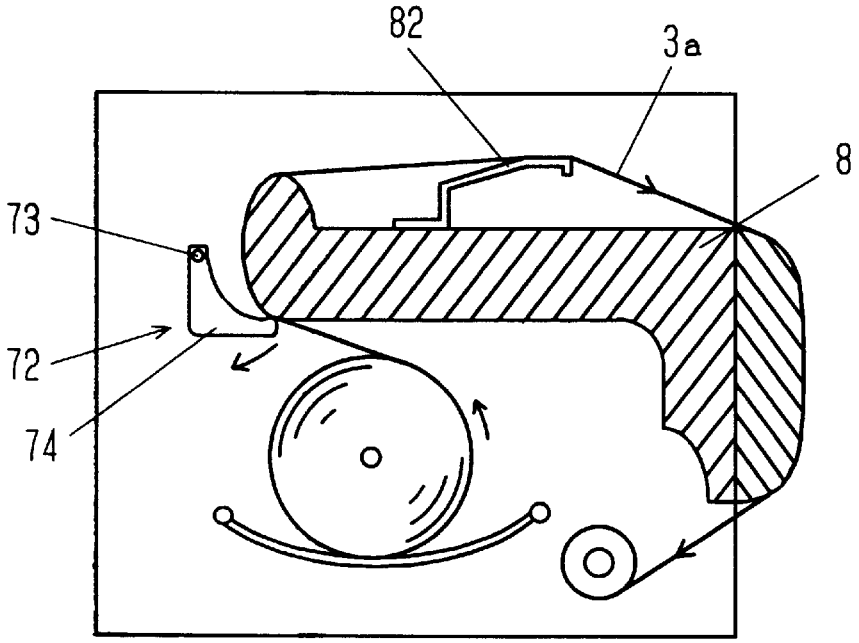
FIG. 26 is a block diagram of another embodiment in which the brake mechanism and the tensioning mechanism are combined.

In the cleaning fabric tensioning mechanism illustrated in FIG. 26, both plate spring 82 and a brake 72 are arranged to be used. The elastic force of the plate spring 82 attached on the support bar 8 presses the back portion of the cleaning fabric 3*a*. The brake 72 consists of a brake tool 74 pivotally mounted on a shaft 73, for movement in the direction of the support bar 8. A driving means (not illustrated in the drawing) such as an air cylinder, operates the brake tool 74 as illustrated in the drawing to press the cleaning fabric 3*a* against the support bar 8. When the cleaning fabric 3*a* is not drawn out, slack in the cleaning fabric 3*a* is absorbed by the plate spring 82 and by applying the brake 72. Consequently, the cleaning fabric 3*a* is always kept tensioned.

It is also preferable that the cleaning fabric reversing means be employed for returning a portion of the used part of the cleaning fabric to the cleaning fabric supply element. FIG. 19 illustrates an example of the cleaning fabric reversing mechanism. The cleaning fabric roll supporting member 41 is urged to move in the direction of the touch roll 61 by the spring 9, and the outer circumference of the cleaning fabric roll is pressed against the touch roll 61 when the cleaning fabric roll 30 is located on the cleaning fabric roll supporting member 41. As illustrated in FIG. 20, driving force of a motor 81 is transmitted to the shaft 62 of the touch roll 61 by a one-way clutch 80.

In this arrangement, the touch roll 61 freely rotates in the cleaning fabric supplying direction, and when the motor is driven, the touch roll 61 is forcibly rotated in the reverse direction to the direction in which it rotates when the cleaning fabric is supplied (reverse rotation). When a part of the cleaning fabric 3*a* supplied from the cleaning fabric supply element 30 is to be reused, the part of the cleaning fabric 3*a* previously supplied is returned to the cleaning fabric supply element 30 by reverse rotation of the touch roll 61 and by rotating the cleaning fabric roll 30 pressed to contact the touch roll 61 in the sequence in which the control means executing the previously programmed cleaning sequence returns the used part of the cleaning fabric 3*a*.

Though in FIG. 19 the cleaning fabric roll 30 is rolled back by reverse rotation of the touch roll 61 in the state in which the cleaning fabric roll 30 contacts the touch roll 61, when only the length of a few centimeter of the fabric is to be rolled back, the cleaning fabric 3*a* may be returned to the cleaning fabric supplying part with the cleaning fabric loosened by reversely sending the cleaning fabric roll 30 in the state in which the cleaning fabric roll 30 doesn't contact the touch roll 61.

As for another embodiment of the cleaning fabric reversing mechanism for returning the cleaning fabric, the cleaning fabric reversing mechanism may be a spring so that force is stored in the spring when the cleaning fabric is supplied and only a predetermined amount of the cleaning fabric is rolled back by the spring force.

Figure 27:
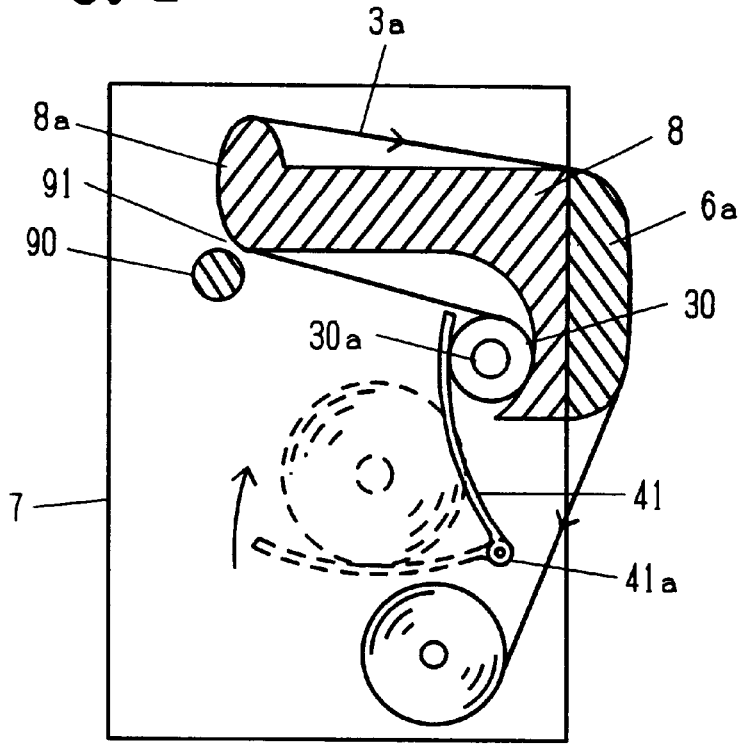
FIG. 27 is a device block diagram of one example of the cleaning fabric roll core disengagement prevention mechanism.

Next, a means for preventing a roll core from disengaging from the cleaning device will be described. FIG. 27 illustrates one embodiment of such a prevention means. The cleaning fabric roll supporting member 41 has one end 41*a* supported on the shaft so as to be rotatable and is urged to move in the direction of the back surface 8*b* of the support bar 8 by the force means such as a spring (not illustrated in the drawing). Near the end portion 8*a*, a roll core disengagement prevention element 90 is positioned along the longitudinal direction of the cleaning fabric roll 30 adjacent to the end portion 8*a*. The prevention element 90 is positioned sufficient close to the end portion 8*a* so that a gap 91 is formed between the element 90 and end portion 8*a* which allows the cleaning fabric 3*a*, but not the roll core 30*a*, to pass therethrough. In other words, the gap 91 is narrower than the diameter of the roll core 30*a*.

Figure 28:
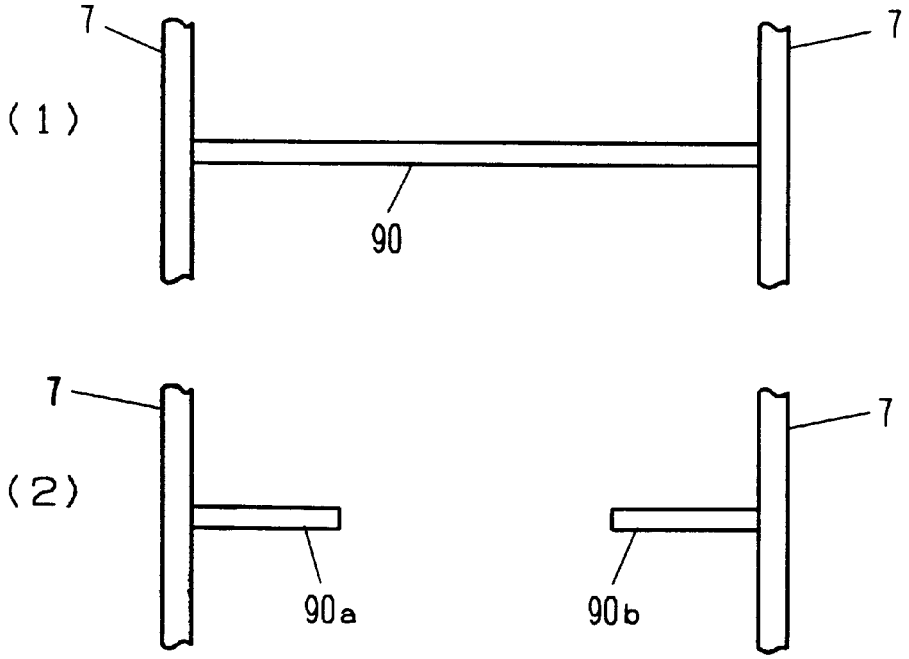
FIG. 28(1) and FIG. 28(2) are diagrams of the arrangements of two embodiments in which the roll core disengagement prevention bodies are seen from the front.

The roll core disengagement prevention element 90 is placed on both side plates 7, and is arranged to act on the entire width of the cleaning fabric roll 30 (i.e. the entire length of the roll core 30*a*), so that this arrangement has an advantage in easily attaching the cleaning fabric roll. A predetermined length of the roll core disengagement prevention element 90*a* and 90*b* illustrated in FIG. 28(2) are provided at both side plates 7 to act on a part of the roll core 30*a* of the cleaning fabric roll 30. Alternatively, the springing out prevention element 90 may extend the full distance between plates 7, as shown in FIG. 28(1).

The cleaning fabric roll supporting member 41 of the present embodiment acts so as to press the cleaning fabric roll 30 against the back surface of the supporting bar 8 on which the pressure pad is positioned; therefore, the roll core 30*a* does not disengagement in normal use. If abnormal force (i.e., more than the force of the cleaning fabric roll supporting member 41 pressing the cleaning fabric roll 30 against the support bar 8) acts on the cleaning fabric 3*a*, the roll core 30*a* disengages with of the cleaning fabric roll supporting member 41. When this happens, the roll core 30*a* is caught between the roll core disengagement prevention element 90 and rear portion 8*a* of the support bar 8, and the roll core 30*a* and the cleaning fabric 3*a* are separated. Only the cleaning fabric 3*a* is drawn out.

Figure 29:
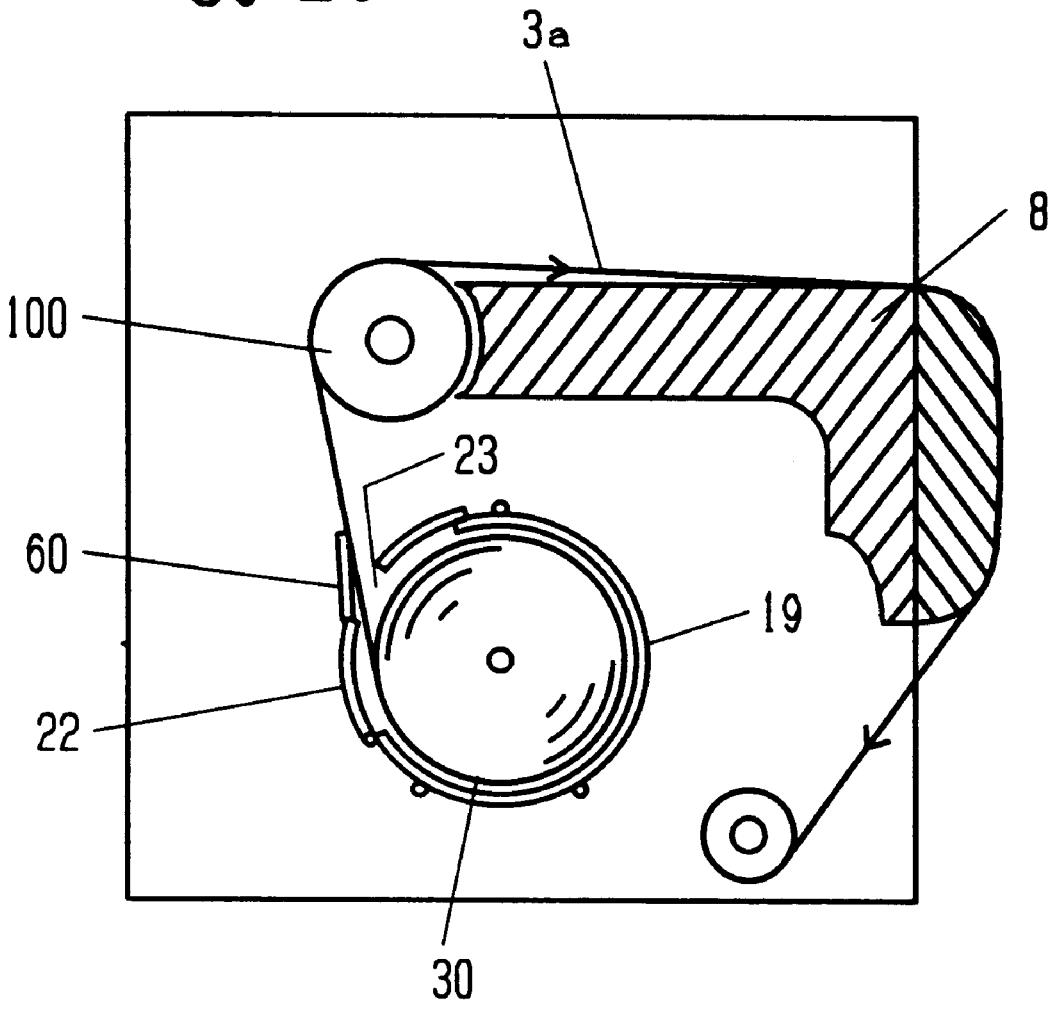
FIG. 29 is a sectional view of one example of the device arrangement provided with a roll which is freely rotatable or rotatable only in the fabric sending direction.

Turning now to FIG. 29, an alternative arrangement for supplying the cylinder pressing part with the cleaning fabric 3*a* will be described. FIG. 29 illustrates the arrangement in which a rotatable roll 100 is located adjacent the support bar end 8*a*. A roll 100 is located at the rear end portion 8*a* of the support bar 8, and can freely rotate in a fabric-supplying and reverse direction, or rotate only in the fabric-supplying direction. At the slit 23 provided on the cover 22 of the container 19, a brake plate 60 is attached so as to keep contact with the cleaning fabric 3*a*.

Near the slit, the brake plate 60 applies the brake on the cleaning clot 3*a* supplied from the cleaning fabric roll 30. The rotatable roll 100 is in contact with the cleaning fabric and the cleaning fabric 3*a* rotates in the feeding direction so that the cleaning fabric 3*a* is smoothly sent. Especially in the case of the cleaning fabric impregnated with a detergent, the danger of squeezing detergent is reduced since there is no portion between the roll 100 and the cylinder pressing part in which the cleaning fabric 3*a* receives compression action that may squeeze solvent therefrom.

The roll 100 can be added to every embodiment of the present invention adopting every brake mechanism except for the embodiment in which the cleaning fabric contact the rear end portion 8*a* of the support bar 8 and the brake is applied between the outer circumference of the rear end portion 8*a* of the support bar and fabric 3A.

Although the present invention has been described in terms of certain preferred embodiments, other embodiments that are apparent to those of ordinary skill in the art are also intended to be within the scope of this invention. Accordingly, the scope of the present invention is intended to be limited only by the claims appended hereto.

What is claimed is:

1. A cylinder cleaning device comprising:

a cleaning fabric supply element including rolled cleaning fabric forming an outer surface of said supply element;

a frame;

a receiving and supporting means connected to said frame for receiving and supporting at least a portion of the outer surface of the cleaning fabric supply element; and a tensioning means for exerting tension on the cleaning fabric received and supported by the receiving and supporting means.

2. The device of claim 1, wherein the tensioning means comprises a brake mechanism.

3. The device of claim 2, wherein the receiving and supporting means is a cross beam.

4. The device of claim 3, wherein the brake mechanism includes a brake pressing means and a brake shoe facing the cross beam, said tension being exerted when the brake pressing means moves the brake shoe to press the portion of the cleaning fabric against the cross beam.

5. The device of claim 3, wherein the cleaning fabric advances through an S-shaped path, wherein the distance of the S-shaped path is varied by the brake mechanism, said tension being exerted as the distance of the S-shaped path increases.

6. The device of claim 5, wherein the brake mechanism includes a rotatable connection element, two non-rotatable bars positioned in parallel to the connection element and an S-wrap driving means for rotating the connection element, wherein the cleaning fabric advances through the two bars in the S-shaped path, wherein the distance of the S-shaped path increases by rotating the two bars with respect to each other by the connection element in a direction which vertically crosses the direction in which the portion of the cleaning fabric advances.

7. The device of claim 3, wherein the cross beam includes a coarse end surface, said tension being exerted when the portion of the cleaning fabric presses against the coarse end surface.

8. The device of claim 3, further comprising an inflatable pressure pad for pressing a second portion of the cleaning fabric against a cylinder, said cross beam comprises a holding element moveable in a direction opposite to the inflation of the inflatable pressure pad by means of a spring, said tension being exerted when the pressure pad deflates and the holding element moves the first portion of the cleaning fabric in the direction opposite to the inflatable pressure pad by the spring means.

9. The device of claim 1, wherein the receiving and supporting means is a cross beam, wherein the tensioning means comprises a pivotable brake mechanism and a plate spring attached to the cross beam, said tension being exerted when slack in the cleaning fabric is absorbed by the plate spring and when the brake mechanism pivots towards the cross beam pressing the portion of the cleaning fabric against the cross beam.

10. The device of claim 3, wherein the brake mechanism is positioned between the cleaning supply element and the cross beam, said brake mechanism exerts a brake force to the cleaning fabric between the cleaning fabric supply element and the cross beam.

11. The device of claim 10, wherein the brake mechanism comprises two brake plates and a pressing means, wherein a second portion of the cleaning fabric is disposed between the brake plates, said tension being exerted when both the brake plates contact the second portion of the cleaning fabric by the pressing means.

12. A cylinder cleaning device comprising:

a cleaning fabric supply element including rolled cleaning fabric forming an outer surface of said supply element;

a frame;

a cross beam connected to said frame, said cross beam receives and supports at least a portion of the outer surface of the cleaning fabric supply element; and a brake mechanism, said brake mechanism exerts tension on the cleaning fabric received and supported by the cross beam.

* * * * *

Disclaimer 6,332,238—Akira Hara, Tokyo; Hiraku Onuma, Yokohama; Hideo Oyaizu, Tokyo; Yuuichi Suzuki, Shiki, All of Japan; C. Robert Gasparrini, Portchester, NY. CYLINDER CLEANING DEVICE. Patent dated December 25, 2001. Disclaimer filed June 4, 2001 by the assignee, Baldwin-Japan Ltd.

The term of this patent shall not extend beyond the expiration date of Pat. No. 6,038,731.

*(Official Gazette, August 13, 2002)*